US005560053A

United States Patent [19]

Mills

[11] Patent Number: 5,560,053

[45] Date of Patent: Oct. 1, 1996

[54] INDEPENDENT TRANSFER DEVICE

[76] Inventor: Larry E. Mills, 116 W. Highland, Brookhaven, Miss. 39601

[21] Appl. No.: 336,765

[22] Filed: Nov. 9, 1994

[51] Int. Cl.[6] ..... A61G 7/10

[52] U.S. Cl. ..... 5/81.1 R; 5/662; 5/658; 5/503.1

[58] Field of Search ..... 5/503.1, 507.1, 5/658, 662, 81.1

[56] References Cited

U.S. PATENT DOCUMENTS

| | | | |
|---|---|---|---|
| D. 285,137 | 8/1986 | Svensson . | |
| 3,407,413 | 11/1968 | James . | |
| 4,375,707 | 3/1983 | Boerigter . | |
| 4,628,550 | 12/1986 | Walton . | |
| 4,642,824 | 2/1987 | Hodges . | |
| 4,932,090 | 6/1990 | Johansson | 5/602 |
| 5,054,137 | 10/1991 | Christensen . | |
| 5,257,425 | 11/1993 | Shinabarger . | |
| 5,263,207 | 11/1993 | Gilbert . | |
| 5,347,666 | 9/1994 | Kippes . | |
| 5,354,022 | 10/1994 | Coonrod | 5/662 X |
| 5,384,927 | 1/1995 | Mardero | 5/662 |
| 5,435,028 | 7/1995 | Frala | 5/662 |

FOREIGN PATENT DOCUMENTS

| | | | |
|---|---|---|---|
| 8202832 | 9/1982 | WIPO | 5/602 |

*Primary Examiner*—Michael F. Trettel
*Attorney, Agent, or Firm*—Novak Druce Reynolds Burt

[57] ABSTRACT

The device enables physically impaired or disabled individuals to transfer themselves from one location to another without the assistance of another individual. In the preferred embodiment, the device comprises a base assembly, a central vertical pole, a pivot assembly, a movement inhibitor and a pair of extending bars. The device may be easily positioned in different places which are frequented by the individual user of the device so as to allow the physically impaired or disabled user to have greater independence and freedom.

15 Claims, 2 Drawing Sheets

INDEPENDENT TRANSFER DEVICE

BACKGROUND OF THE INVENTION

1) Field of the Invention

The present invention relates generally to devices for assisting in the movement of physically impaired individuals for one location to another, and more particularly to a device for allowing a physically impaired individual to transfer themselves from one location to another without the aid of another individual.

2) Description of the Related Art

Individuals who are physically impaired or disabled usually must rely on the assistance of another individual to transfer themselves from one location to another. Assistance is usually needed with the most simplest of tasks such as maneuvering from a wheel chair to a bed and vice versa. Most disabled or physically impaired individuals feel helpless and robbed of their independence when they need to rely on others for such simple task like maneuvering from a wheel chair to a bed. These individuals desire the freedom to transfer for themselves and not to rely on others.

The inventive minds of those who work with disabled or physically impaired individuals such as occupational or physically therapist have brought forth several inventions which facilitate the transferring of such individuals from one location to another. One of these invention is disclosed in Christensen, U.S. Pat. No. 5,054,137. Christensen discloses an apparatus which facilitates the transferring of a disabled or physically impaired individual from one location to another location. However, the Christensen invention is designed to operate with the assistance of an attending person who rotates the platform to correctly orient the individuals with respect to the wheel chair or other location.

Another invention which was designed to assist invalids and the handicapped is disclosed in Hodges, U.S. Pat. No. 4,642,824. The invention of Hodges is a bed access apparatus which is connected to a bed and allows the disabled or physically impaired individual to transfer themselves in and out of bed without mechanical assistance and often without assistance from another individual. The Hodges invention is a structural framework with overhead bars which allow the disabled or physically impaired individual to raise themselves out of bed by grasping onto the bars and shifting themselves to the edge of the bed where they can then grasp an outrigger bar to place themselves in a wheel chair.

Several other inventions use similar designs to allow a disabled or physically impaired individual to raise themselves out of bed or the shower through grabbing onto a stationary bar structure. However, what is needed is a device which allows a disabled or physically impaired individual to transfer themselves from one location to another without the assistance of another individual, and which is not a fixed structure so as to be able to position the device in multiple locations if necessary.

SUMMARY OF THE INVENTION

It is an object of the present invention to provide an independent transfer device which allows a disabled or physically impaired individual to transfer themselves from one location to another without the assistance of another individual.

It is a further object of the present invention to provide an independent transfer device which is portable and allows for positioning in a multitude of locations for use by a disabled or physically impaired individual in transferring themselves.

It is a further object of the present invention to provide an independent transfer device which is simple to operate and requires minimal space.

To accomplish the above-stated objects, the novel independent transfer device of the present invention essentially comprises a base assembly, a central vertical pole, a pivot assembly, a movement inhibitor and a pair of extending bars. The novel independent transfer device of the present invention allows physically impaired or disabled individuals to transfer themselves from one location to another without assistance from another individual. The base assembly provides support and stabilization during transferring of the individual by themselves. The base assembly consists of a forward bar, a left outer bar, a right outer bar and a flat stabilizing plate. The forward bar has a central aperture, a right end and a left end and provides a forward boundary of the base assembly. The left outer bar is connected perpendicularly to the left end of the forward bar and the right outer bar is connected perpendicularly to the right end of the forward bar. The flat stabilizing plate is rectangular in shape and has a top end and a bottom end. The forward bar, the right bar and the left bar attach to the peripheries of the top end of the flat stabilizing plate thereby forming a raised boundary around the sides and forward end of the rectangle of the flat stabilizing plate and allowing for an open rearward end of the flat stabilizing plate for ingress and egress of the individual in a wheel chair.

The central vertical pole of the device of the present invention has an upper end and a lower end. The lower end of the central vertical pole is engaged with the central aperture of the forward bar, with central vertical pole extending upward from the forward bar. The central vertical pole has a hollow interior with a bearing means therein for rotation of the pivot assembly. The central vertical pole also has an opening at the upper end for access therethrough to the hollow interior.

The novel pivot assembly of the device of the present invention allows for the individual to rotate themselves from one location to another without assistance from others. The pivot assembly consists of a L-shaped coupling bar and a hand grip bar. The L-shaped coupling bar has a vertical section and a horizontal section. The vertical section is substantially positioned within the hollow interior of the central vertical bar through the upper end opening. The vertical section is engaged with the bearing means thereby allowing for rotation of the pivot assembly. The horizontal section extends in a horizontal plane substantially perpendicular to the central vertical pole. The horizontal section is connected to the center of the hand grip bar thereby forming a T-shaped unit. The hand grip bar has a right end and a left end, with each end having a hand grip means attached thereto for allowing the individual to firmly grasp the hand grip bar while rotating themselves and the pivot assembly during transfer from one location to another.

The movement inhibitor of the device of the present invention is located on the central vertical pole. The movement inhibitor engages with the vertical section of said L-shaped coupling bar so as to prevent rotation of the pivot assembly beyond a position where the base assembly provides support and stabilization. The left extending bar and a right extending bar of the device of the present invention are connected to the base assembly. The right extending bar is connected to the right outer bar and the left extending bar is connected to the left outer bar. The right extending bar is in the same horizontal plane as and extends rearwardly from the right outer bar; the left extending bar is in the same horizontal plane as, and extends rearwardly from the left outer bar. The right extending bar and the left extending bar add further support and stabilization to the base assembly.

In another embodiment, the novel independent transfer device of the present invention comprises a pivot assembly and a support means. The pivot assembly is as described above while the support means can take various forms. The support means can be a wall bracket attached to a wall or other fixed structure. The support means can be a bracket attached to the interior of an automobile. The support means can also be a bracket attached to a wheelchair or other mobile devices.

As a modification on the various embodiments, the hand grip can be specially designed to facilitate grasping by an individual suffering from a particular disability. In the case of an individual suffering from cerebral palsy, the hand grips could be designed in a U-shape in order to facilitate the grasping by the individual. For other disabilities, the hand grips would be designed accordingly to facilitate grasping by the individual.

BRIEF DESCRIPTION OF THE DRAWINGS

The present invention is further described in connection with the accompanying drawings, in which:

There is illustrated in FIG. 1 a rear perspective of the present invention.

Figure 2:
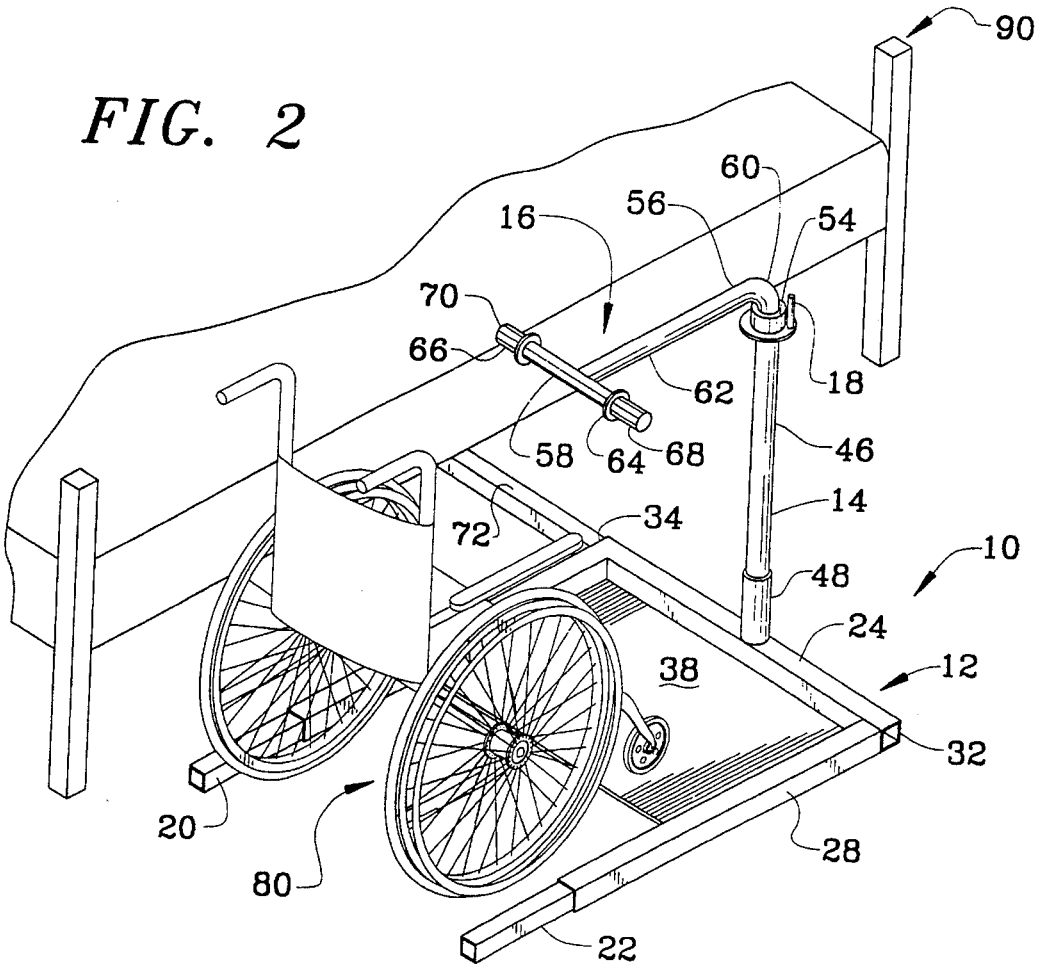
Figure 3:
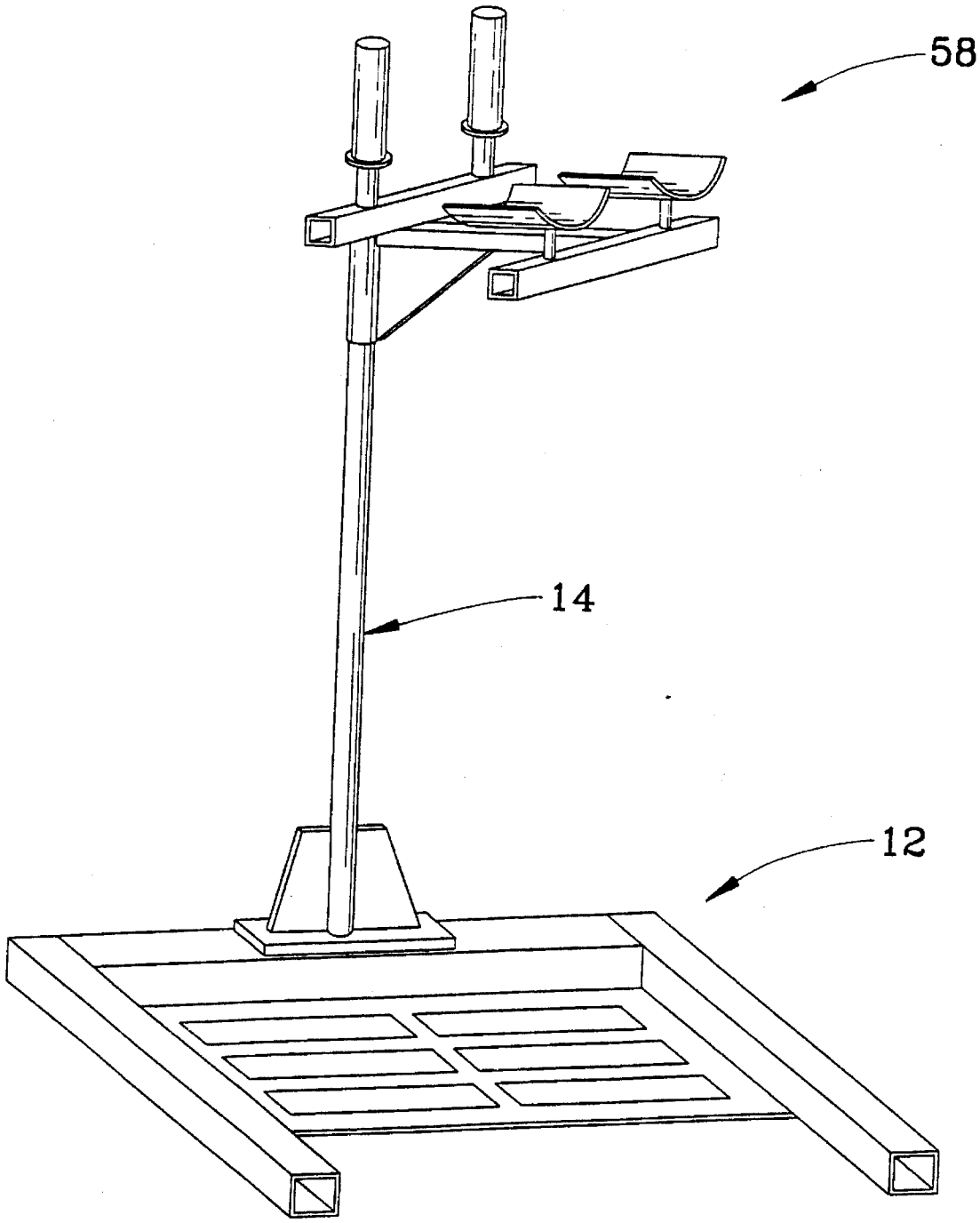

There is illustrated in FIG. 2 a rear perspective of the present invention in utilization with a wheel chair and positioned next to a bed. There is illustrated in FIG. 3 a rear perspective view of the present invention having U-shaped hand holds.

DETAILED DESCRIPTION OF THE INVENTION

Figure 1:
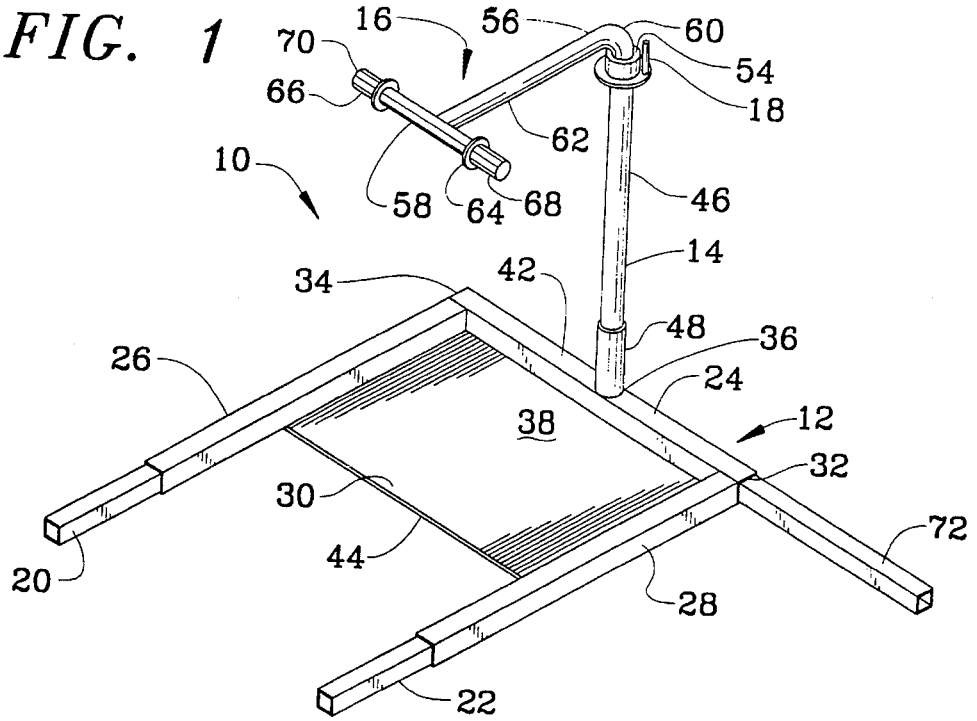

There is illustrated in FIG. 1 a rear perspective of the present invention. Referring to FIG. 1, independent transfer device 10 of the present invention is comprised essentially of base assembly 12, central vertical pole 14, pivot assembly 16, movement inhibitor 18 and left and right extending bars 20 and 22. Device 10 is designed to provide a physically impaired or disabled individual with the ability to transfer themselves from one location to another location without assistance from another individual. The physically impaired or disabled individuals may be: afflicted with muscular dystrophy, multiple sclerosis, or cerebral palsy; cerebrol vascular accident (stroke) patients; low thoracic paraplegics or other incomplete spinal cord injured persons; suffers of orthopedic injuries, brain injuries or arthritis; and nursing home residents and the like. Device 10 provides these individuals with the capability to rely upon themselves during simple task of transferring from one location to another.

Base assembly 12 of device 10 provides support and stabilization during transferring of the individual by themselves from one location to another. Base assembly 12 consists of forward bar 24, left outer bar 26, right outer bar 28 and flat stabilizing plate 30. Forward bar 24 has right end 32 and left end 34 and also a central aperture 36 at its midpoint. In the preferred embodiment, forward bar 24 is approximately seventy-one centimeters in length from right end 32 to left end 34. Left outer bar 26 is connected to forward bar 24 at left end 34. Right outer bar 28 is connected to forward bar 24 at right end 32. Left outer bar 26 and right outer bar 28 extend rearward from forward bar 24. In the preferred embodiment, left outer bar 26 and right outer bar 28 are each approximately forty-six centimeters in length. Flat stabilizing plate 30 has a top side 38, 38, a bottom side, a forward end 42, and a rearward end 44. In the preferred embodiment, flat stabilizing plate 30 is rectangular in shape with a rectangular length of approximately seventy-one centimeters and a rectangular width of approximately forty-six centimeters. However, other embodiments may have flat stabilizing plates of various shapes such as circles and triangles. Forward bar 24, left outer bar 26 and right outer bar 28 are attached to the periphery of the top side 38 of flat stabilizing plate 30 thereby forming a raised boundary around the left and right sides and forward end 42 of the flat stabilizing plate 30. Rearward end 44 of flat stabilizing plate 30 is left open for ingress and egress of a wheel chair.

Central vertical pole 14 has a upper end 46 and a lower end 48. Lower end 48 is engaged with central aperture 36 of forward bar 26. Central vertical pole 14 has a hollow interior 50 with a bearing means 52 therein. Upper end 46 has an opening 54 for access therethrough to hollow interior 50. Bearing means 52 allows for rotation of pivot assembly 16. In the preferred embodiment, central vertical pole 14 is approximately ninety-one centimeters to one-hundred seven centimeters in length. However, the length of central vertical pole 14 may be adjusted to accommodate the individual user of device 10.

Pivot assembly 16 consists of L-shaped coupling bar 56 and hand grip bar 58. Pivot assembly 16 allows the individual to rotate themselves for one location to another. L-shaped coupling 56 has vertical section 60 and horizontal section 62. Vertical section 60 is substantially positioned in hollow interior 50 of central vertical pole 14 through upper end opening 54. Vertical section 60 is engaged with bearing means 52 thereby allowing for rotation of pivot assembly 16. Horizontal section 62 extends in a horizontal plane substantially perpendicular to central vertical pole 14. In the preferred embodiment, horizontal section 62 is approximately thirty-eight centimeters in length, however, the length of horizontal section 62 may vary depending on the individual user of device 10. Horizontal section 62 is connected to the center of hand grip bar 58 thereby forming a T-shaped unit. Hand grip bar 58 has a right end 64 and a left end 66, each end 64 and 66 with a hand grip 68 and 70 attached thereto. Hand grips 68 and 70 allow the individual to firmly grasp device 10 while transferring themselves from one location to another without assistance from others. In the preferred embodiment, hand grip bar 58 is approximately thirty-eight centimeters in length, however other lengths and designs are available depending on the individual user of device 10.

Movement inhibitor 18 is located upon the central vertical pole 14. Movement inhibitor 18 engages with vertical section 60 of L-shaped 56 so as to prevent rotation of pivot assembly 16 beyond a position where base assembly 12 provides support and stabilization. In the preferred embodiment, movement inhibitor 18 would only allow one-hundred eighty degree movement of pivot assembly 16 from one end to the other end.

Left extending bar 20 and right extending bar 22 are connect to base assembly 12 at left outer bar 26 and right outer bar 28 respectively. Extending bars 20 and 22 extend rearwardly and in the same horizontal plane as their corresponding outer bars 26 and 28. Extending bars 20 and 22 provide added support and stabilization to base assembly 12. In the preferred embodiment, left extending bar 20 and right extending bar 22 are each approximately forty-six centimeters in length.

Outward extending member 72 is connected to forward bar 24 at either right end 32 or left end 34. Outward extending member 72 lies in the same horizontal plane as forward bar 24. Outward extending member 72 will be connected to the end, either right end 32 or left end 34 of forward bar 24, on which the individual will be rotating to when transferring from one location to another. For example, if a bed is off to the right, outward extending member 72 will be connected to right end 32 so as to add support and stabilization to that end during transferring. In the preferred embodiment, outward extending member 72 is approximately forty-six centimeters in length.

There is illustrated in FIG. 2 a rear perspective of the present invention in utilization with a wheel chair and positioned next to a bed. Referring to FIG. 2, device 10 is utilized in conjunction with a wheel chair 80 and positioned next to bed 90. Device 10 is positioned next to bed 90 so as to enable an individual user of device 10 to transfer themselves from wheel chair 80 into bed 90 without the assistance of another individual. Outward extending member 72 is located on left end 34 of forward bar 24 so as to give further support and stabilization to device 10 when the individual user is using device 10 to rotate from bed 90 to wheel chair 80 or vice versa. Wheel chair 80 is rolled up to flat stabilizing plate 30 from the opening on the rearward end 44. If transferring from the wheel chair 80 to bed 90, the user would grab onto hand grips 68 and 70 of hand grip bar 58. The user would then rotated themselves and pivot assembly 16 to the left in order to transfer to the bed 90. Movement inhibitor 18 would prevent pivot assembly 16 from rotating beyond a ninety-degree angle from the initial starting position as shown in FIG. 2. In this way, device 10 only allows rotation to a point where device 10 can stabilize the transfer.

While the preferred embodiment of the invention has been shown and described, it will be apparent to those skilled in this art that various modifications may be made in the embodiment without departing from the spirit of the present invention. Therefore, the embodiments of the invention in which an exclusive property or privilege is claimed are defined as follows:

I claim:

1. An independent transfer device for allowing a physically impaired individual to transfer themselves from one location to another without assistance from another individual, the device comprising:

a base assembly for support and stabilization during transferring of the individual by themselves, said base assembly having a forward bar, a left outer bar, a right outer bar and a flat stabilizing plate, said forward bar having a central aperture, a right end and a left end, said left outer bar connected perpendicularly to said left end of said forward bar and said right outer bar connected perpendicularly to said right end of said forward bar, said flat stabilizing plate rectangular in shape and having a top end and a bottom end, said forward bar, said right bar and said left bar attached to the peripheries of said top end of said flat stabilizing plate thereby forming a raised boundary around the sides and forward end of the rectangle of said flat stabilizing plate and allowing for an open rearward end of said flat stabilizing plate for ingress and egress;

a central vertical pole having an upper end and a lower end, said lower end of said central vertical pole engaged with said central aperture of said forward bar, said central vertical pole extending upward from said forward bar, said central vertical pole having a hollow interior with a bearing means therein for rotation and said central vertical pole having an opening at said upper end for access therethrough to said hollow interior;

a pivot assembly for allowing the individual to rotate themselves from one location to another, said pivot assembly having a L-shaped coupling bar and a hand grip bar, said L-shaped coupling bar having a vertical section and a horizontal section, said vertical section substantially positioned therein said hollow interior of said central vertical bar through said upper end opening, said vertical section engaged with said bearing means thereby allowing for rotation of said pivot assembly, said horizontal section extending in a horizontal plane substantially perpendicular to said central vertical pole and connected to the center of said hand grip bar thereby forming a T-shape, said hand grip bar having a right end and a left end, each of said ends having a hand grip means attached thereto for allowing the individual to firmly grasp said hand grip bar while rotating themselves and said pivot assembly during transfer from one location to another;

a movement inhibitor located on said central vertical pole, said movement inhibitor engaging with said vertical section of said L-shaped coupling bar so as to prevent rotation of said pivot assembly beyond a position where said base assembly provides support and stabilization; and, a left extending bar and a right extending bar, said right to extending bar connected to said base assembly at said right outer bar and said left extending bar connected to said base assembly at said left outer bar, said right extending bar in the same horizontal plane as and extending rearward from said right outer bar, said left extending bar in the same horizontal plane as and extending rearward from said left outer bar, said right extending bar and said left extending bar adding further support and stabilization to said base assembly.

2. The device according to claim 1 further comprising an outward extending member, said outward extending member connected to said forward bar, said outward extending member in the same horizontal plane and extending outward from said forward bar, said outward extending member connected to said end of said forward bar where rotation of said pivot assembly is likely, said outward extending member providing further support and stabilization during transferring of the individual by themselves.

3. The device according to claim 1 wherein said base assembly, said left extending bar and right extending bar are composed of a material which enables said base assembly, said left extending bar and right extending bar to have sufficient weight to stabilize and support the individual during transferring by themselves.

4. The device according to claim 1 wherein said hand grip bar is designed in a U-shape in order to facilitate grasping by an individual suffering from a disability such as cerebral palsy.

5. An independent transfer device for allowing a physically impaired individual to transfer themselves from a wheel chair to another position without assistance from another individual, the device comprising:

a base assembly for support and stabilization during transferring of the individual by themselves, said base assembly having a forward bar, a left outer bar, a right outer bar and a flat stabilizing plate, said forward bar having a central aperture, a right end and a left end, said left outer bar connected perpendicularly to said left end of said forward bar and said right outer bar connected perpendicularly to said right end of said forward bar, said flat stabilizing plate rectangular in shape and having a top end and a bottom end, said forward bar, said right bar and said left bar attached to the peripheries of said top end of said flat stabilizing plate thereby forming a raised boundary around the sides and forward end of the rectangle of said flat stabilizing plate and allowing for an open rearward end of said flat stabilizing plate for ingress and egress by the wheel chair;

a central vertical pole having an upper end and a lower end, said lower end of said central vertical pole engaged with said central aperture of said forward bar, said central vertical pole extending upward from said forward bar, said central vertical pole having a hollow interior with a bearing means therein for rotation and said central vertical pole having an opening at said upper end for access therethrough to said hollow interior;

a pivot assembly for allowing the individual to rotate themselves from one location to another, said pivot assembly having a L-shaped coupling bar and a hand grip bar, said L-shaped coupling bar having a vertical section and a horizontal section, said vertical section substantially positioned therein said hollow interior of said central vertical bar through said upper end opening, said vertical section engaged with said bearing means thereby allowing for rotation of said pivot assembly, said horizontal section extending in a horizontal plane substantially perpendicular to said central vertical pole and connected to the center of said hand grip bar thereby forming a T-shape, said hand grip bar having a right end and a left end, each of said ends having a hand grip means attached thereto for allowing the individual to firmly grasp said hand grip bar while rotating themselves and said pivot assembly during transfer from the wheel chair to another position;

a movement inhibitor located on said central vertical pole, said movement inhibitor engaging with said vertical section of said L-shaped coupling bar so as to prevent rotation of said pivot assembly beyond a position where said base assembly provides support and stabilization; and, a left extending bar and a right extending bar, said right extending bar connected to said base assembly at said right outer bar and said left extending bar connected to said base assembly at said left outer bar, said right extending bar in the same horizontal plane as and extending rearward from said right outer bar, said left extending bar in the same horizontal plane as and extending rearward from said left outer bar, said right extending bar and said left extending bar adding further support and stabilization to said base assembly.

6. The device according to claim 5 further comprising an outward extending member, said outward extending member connected to said forward bar, said outward extending member in the same horizontal plane and extending outward from said forward bar, said outward extending member connected to said end of said forward bar where rotation of said pivot assembly is likely, said outward extending member providing further support and stabilization during transferring of the individual by themselves.

7. The device according to claim 5 wherein said base assembly, said left extending bar and right extending bar are composed of a material which enables said base assembly, said left extending bar and right extending bar to have sufficient weight to stabilize and support the individual during transferring by themselves.

8. The device according to claim 5 wherein said hand grip bar is designed in a U-shape in order to facilitate grasping by an individual suffering from a disability such as cerebral palsy.

9. A free standing transfer device for assisting a patient in transferring themselves from one position to a second position, said transfer device comprising:

a base assembly for supporting and stabilizing said transfer device during the transfer process, said base assembly having a stabilizing plate oriented to lay flush against the ground when in use;

said stabilizing plate having a raised boundary about at least a portion of a periphery of said plate for retarding rolling access of a wheel chair thereacross and an open portion about another portion of said periphery that permits rolling ingress and egress of a wheel chair to said base assembly thereby encouraging proper orientation of a wheel chair with respect to said transfer device prior to making a patient transfer; and a substantially vertical support having a rotatable connection by which a hand grip is pivotally connected to said base assembly for allowing a patient to independently pivot themselves from one position to a second position.

10. The free standing transfer device as recited in claim 9, said transfer device further comprising:

a movement inhibitor for restricting pivotal movement of said hand grip to a range through which said transfer device is stable.

11. The free standing transfer device as recited in claim 10, wherein said range of allowed pivotal motion of said hand grip is approximately 180 degrees.

12. The free standing transfer device as recited in claim 9, said transfer device further comprising:

said hand grip having double hand holds.

13. The free standing transfer device as recited in claim 12, said double hand holds being U-shaped.

14. The free standing transfer device as recited in claim 9, said transfer device further comprising:

at least one stabilizing bar projecting outwardly from said base assembly toward the second position of the patient in an orientation that is at ground level and substantially parallel to said stabilizing plate for providing increase stability during a patient transfer between the first position and the second position.

15. An independent transfer device for allowing a physically impaired individual to transfer themselves from one location to another without assistance from another individual, the device comprising:

a support means for supporting and stabilizing the device while in use by the physically impaired individual, said support means containing a bearing means for rotation of the device and having an aperture for access to said bearing means;

a pivot assembly for allowing the individual to rotate themselves from one location to another, said pivot assembly having a L-shaped coupling bar and a hand grip bar, said L-shaped coupling bar having a vertical section and a horizontal section, said vertical section substantially positioned within said support means through said aperture, said vertical section engaged with said bearing means thereby allowing for rotation of said pivot assembly, said horizontal section extending in a horizontal plane substantially perpendicular to said support means and connected to the center of said hand grip bar thereby forming a T-shape, said hand grip bar having a right end and a left end, each of said ends having a hand grip means attached thereto for allowing the individual to firmly grasp said hand grip bar while rotating themselves and said pivot assembly during transfer from one location to another; and a movement inhibitor located on said support means, said movement inhibitor engaging with said vertical section of said L-shaped coupling bar so as to prevent rotation of said pivot assembly beyond a position where said support means provides support and stabilization; and said support means is a bracket attached to a wheel chair thereby facilitating the transfer of the individual from the wheelchair to another location without the assistance of another individual.

* * * * *